US005474340A

United States Patent [19]

Brackmann et al.

[11] Patent Number: 5,474,340

[45] Date of Patent: Dec. 12, 1995

[54] THEFT-RESISTANT MOTOR-VEHICLE DOOR LATCH

[75] Inventors: Horst Brackmann, Velbert; Rainer Kipka, Essen, both of Germany

[73] Assignee: Kiekert GmbH & Co. KG, Heiligenhaus, Germany

[21] Appl. No.: 168,811

[22] Filed: Dec. 16, 1993

[30] Foreign Application Priority Data

Jan. 15, 1993 [DE] Germany ..... 43 00 885.2

[51] Int. Cl.[6] ..... E05C 3/16

[52] U.S. Cl. ..... 292/216; 292/DIG. 23

[58] Field of Search ..... 292/201, 216, 292/336.3, 337, DIG. 23

[56] References Cited

U.S. PATENT DOCUMENTS

| | | | |
|---|---|---|---|
| 3,334,934 | 8/1967 | Sandor | 292/216 |
| 3,670,536 | 6/1972 | Klebba | 292/106 |
| 3,848,910 | 11/1974 | Wilfert et al. | 292/216 |
| 4,342,209 | 4/1982 | Kleefeldt . | |
| 4,364,249 | 12/1982 | Kleefeldt . | |
| 4,382,622 | 5/1983 | Ishikawa | 292/216 |
| 4,440,006 | 4/1984 | Kleefeldt . | |
| 4,969,673 | 11/1990 | Portelli et al. | 292/216 |
| 4,978,154 | 12/1990 | Klefeldt . | |
| 5,071,178 | 12/1991 | Brackmann et al. | 292/216 |
| 5,137,311 | 8/1992 | Brackmann | 292/216 |

*Primary Examiner*—Peter M. Cuomo
*Assistant Examiner*—Tuyet Pham
*Attorney, Agent, or Firm*—Herbert Dubno; Andrew Wilford

[57] ABSTRACT

A motor-vehicle door latch has a latch fork pivotal on a housing between a holding position in which it is adapted to retain a door of the vehicle closed and a releasing position in which it allows the vehicle door to be opened. A latch pawl is pivotal on the housing between a retaining position engaging the fork and retaining it in the holding position and a freeing position out of engagement with the fork and permitting it to move into the releasing position. A door handle and lock mechanism in the housing are connected to the pawl for moving the pawl into the freeing position on actuation of the handle. A locking lever connected to the mechanism is displaceable between a locked position in which it disconnects the mechanism from the pawl and prevents the mechanism from moving the pawl into the freeing position and an unlocked position in which it permits the mechanism to move the pawl into the freeing position. A blocking element has a part engageable directly with the pawl and is pivotal in the housing between a blocking position preventing movement of the pawl into the freeing position and an unblocking position permitting the pawl to move between its positions. A link between the blocking element and the locking lever displaces the blocking element into the blocking position on displacement of the locking lever into the locked position.

6 Claims, 3 Drawing Sheets

THEFT-RESISTANT MOTOR-VEHICLE DOOR LATCH

SPECIFICATION

1. Field of the Invention

The present invention relates to a motor-vehicle door latch. More particularly this invention concerns such a latch specifically designed to prevent unauthorized actuation of the latch.

2. Background of the Invention

A standard motor-vehicle door latch comprises a bolt normally fixed to the door post and a latch housing carried on the door edge and provided with a pivotal fork that can engage over the bolt when it is moved in a closing direction into engagement with it to lock the door relative to the door post. A latch pawl is pivotal in the lock housing between a retaining position holding the fork engaged around the bolt and preventing the bolt from being retracted from the fork, and a freeing position permitting the fork to pivot and release the bolt. This pawl in turn can be operated by inside and outside operating members to open the door. Inside and outside locking elements are also provided which can disconnect and/or block the inside and outside operating members to prevent the door from being opened by them. Such a latch can be operated by a central locking system as described in commonly owned U.S. Pat. Nos. 4,342,209, 4,364,249, 4,440,006, and 4,978,154 and can have a so-called antitheft position in which, when the door is locked, it cannot be opened even from inside by operating the inside handle and/or locking element.

In the known latches it is possible for a thief to directly actuate the latch pawl and open the door even if the inside or outside locking element is in the looked position. This is done by sliding a thin bar, a so-called "slim jim," down adjacent the window glass and hooking the pawl so it can be pulled or pushed to release the fork. This can even be done in a car equipped with an antitheft system which disconnects the inside locking element from the latch mechanism when the door is locked.

OBJECTS OF THE INVENTION

It is therefore an object of the present invention to provide an improved motor-vehicle door latch.

Another object is the provision of such an improved motor-vehicle door latch which overcomes the above-given disadvantages, that is which is resistant to direct actuation of the latch pawl.

SUMMARY OF THE INVENTION

A motor-vehicle door latch has according to the invention a latch fork pivotal on a housing between a holding position in which it is adapted to retain a door of the vehicle closed and a releasing position in which it allows the vehicle door to be opened. A latch pawl is pivotal on the housing between a retaining position engaging the fork and retaining it in the holding position and a freeing position out of engagement with the fork and permitting it to move into the releasing position. A door handle and lock mechanism in the housing are connected to the pawl for moving the pawl into the freeing position on actuation of the handle. A locking lever connected to the mechanism is displaceable between a locked position in which it disconnects the mechanism from the pawl and prevents the mechanism from moving the pawl into the freeing position and an unlocked position in which it permits the mechanism to move the pawl into the freeing position. A blocking element has a part engageable directly with the pawl and is pivotal in the housing between a position blocking movement of the pawl into the freeing position and an unblocking position clear of the pawl and permitting it to move between its positions. A link between the blocking element and the locking lever displaces the blocking element into the blocking position on displacement of the locking lever into the locked position.

Thus with the system of this invention the blocking element physically prevents the pawl from moving into the freeing position. Even if a jimmy is slipped into the lock mechanism and engaged with this pawl, it cannot be moved and the door cannot be unlocked. This is most effectively done when the pawl and blocking element are pivotal about parallel axes and, in the blocking position of the element and retaining position of the pawl, the pawl bears radially of the blocking element axis on the blocking element.

In a system with a power actuator connected to the locking lever to move it between its positions, the fork is provided with an actuator element preventing movement of the blocking element into the blocking position except in the holding position of the fork. The link includes a spring connected between the blocking element and the locking element and urging the blocking element into the blocking position when the locking lever is in the locked position. More specifically, the actuator element is formed directly on the fork and the blocking lever has a surface directly engageable with the actuator element. The actuator element is a pin projecting from the fork and the surface is an edge of the blocking element. Thus the blocking element will only be pulled into the blocking position when the fork is in the holding position. As a result if the door is open, the pawl is not blocked until the door is closed.

In a system with no power actuator it is desirable to make it impossible to lock the door while it is open. In such an arrangement the above-described actuator element and surface are employed, but the blocking element and locking lever are integral with each other so that in effect the link means interconnecting them is the material of the unitary parts. The pawl has a pin received in a slot of the blocking element in the unblocking position, and the blocking element can only pivot, moving the slot transversely of the slot, into the blocking position when this pin is moved out of this slot, which only happens in the retaining position of the pawl.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
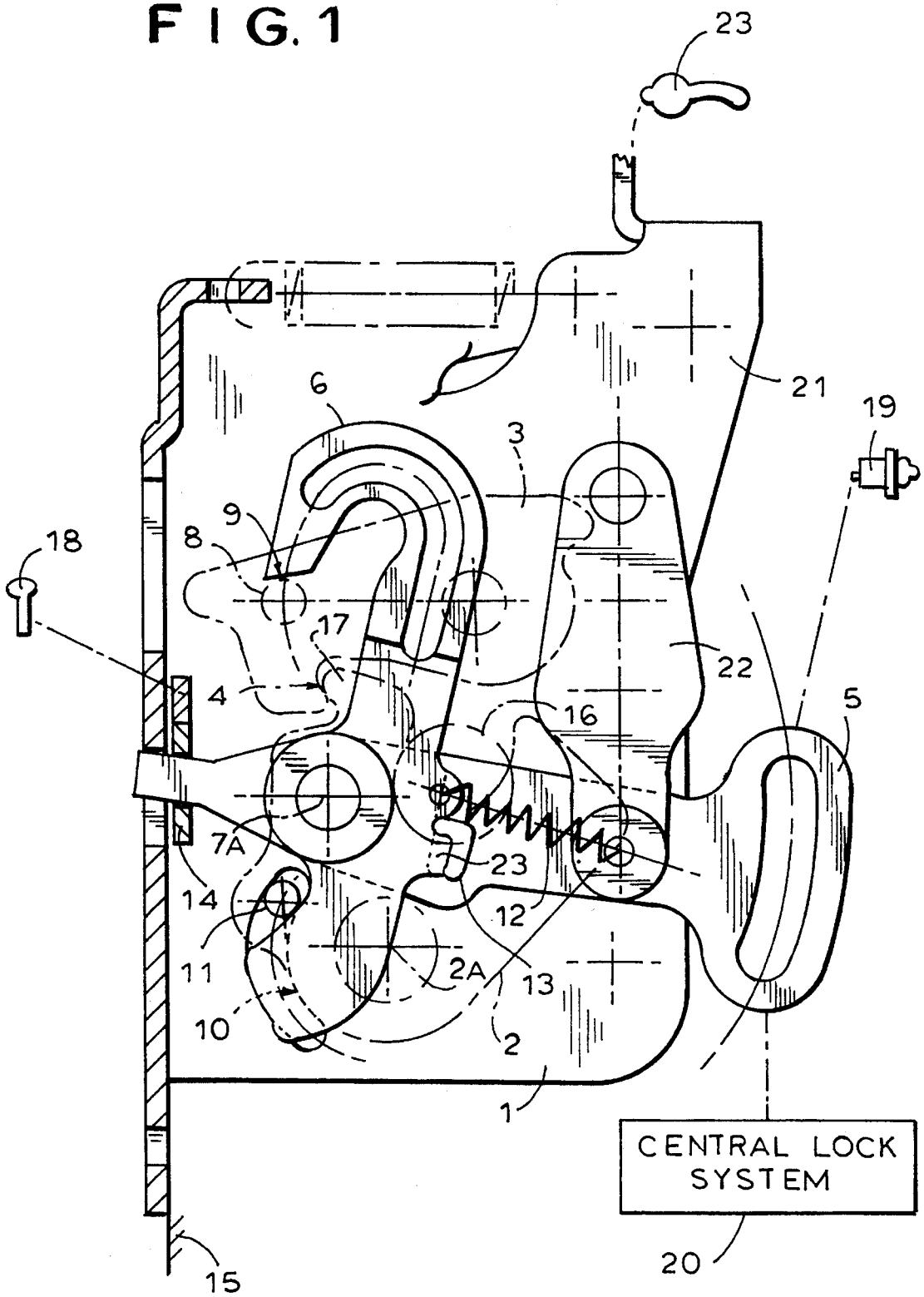
FIG. 1 is a side view partly in section and partly diagrammatic illustrating the tamper-resistant latch according to the invention in the locked position.
Figure 2:
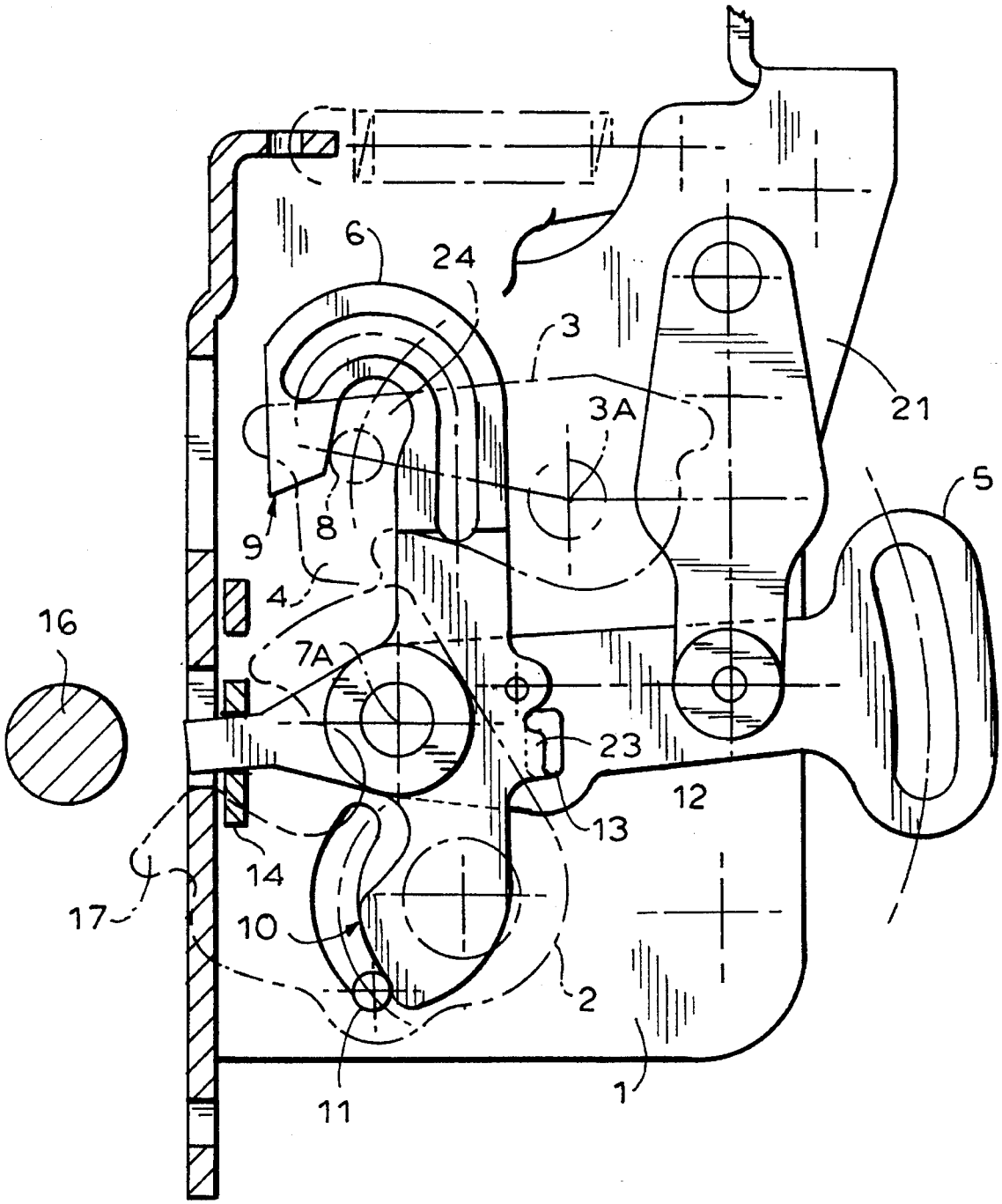
FIG. 2 is a view like FIG. 1 of the latch in the unlocked position.

As seen in FIGS. 1 and 2 a latch according to the invention has a housing 1 normally fixed on a motor-vehicle door edge indicated schematically at 15 and into which a door bolt 16 mounted on a door post can fit. A latch fork 2 is pivotal about an axis 2A in the housing 1 between a holding position engaging around and holding the bolt 16 as seen in FIG. 1 and a releasing position permitting the bolt 16 to move out of the housing 1 as seen in FIG. 2. A latch pawl 3 pivotal about an axis 3A in the housing 1 parallel to the axis 2A has a nose 4 that can hook over a complementary formation 17 on the fork 2. This pawl 3 is movable between a retaining position shown in FIG. 1 engaged with the fork 2 to keep it in the holding position and a freeing position shown in FIG. 2 permitting the fork to pivot into the releasing position. Actuating mechanism 21 is connected in the manner well known in the art to a handle 23 and to the pawl 3 to move it between these positions.

A locking lever 5 is pivotal on a pin 7 defining an axis 7A parallel to the axes 2A and 3A on the housing 1. This lever is connected via a link 22 to the actuating mechanism 21 to couple and decouple it from the pawl 3 as the lever 5 moves from the locked position shown in FIG. 1 to the unlocked position of FIG. 2. This locking lever 5 can be operated via a lever 14 from an inside locking element like the button 18 or from an outside locking element like the cylinder 19 on the door. In addition a central locking system such as illustrated schematically at 20 can pivot it between its locked and unlocked positions. All this mechanism is generally standard.

According to the invention a blocking element or lever 6 is pivoted on the pivot pin 7 and has an end 9 that can engage a pin 8 on the pawl 3 so that in a blocking position of this lever 6 as shown in FIG. 1 the pawl 3 cannot be pivoted into the freeing position. In an unblocking position shown in FIG. 2 such movement of the pawl 3 is possible by movement of the pin 8 in a slot 24 formed in the lever 6. The lever 6 has a tab 23 engaged in a hole 13 formed in the lever 5 to form a lost-motion coupling between these two levers 5 and 6. A tension spring 12 connected between the lever 6 and the lever 5 pulls the lever 6 toward the blocking position when the lever 5 is in the locked position. A pin 11 carried on the fork 2 can engage a cam surface 10 of the lever 6 to hold it against the force of the spring 12 in the releasing position of the fork 2.

Thus when the door is closed and the lever 5 is moved into the locked position (FIG. 1) the tab 23 and spring 12 pull the lever 6 over into the blocking position. Subsequently the pawl 3 cannot be moved into the freeing position even if it is acted on directly since the end 9 of the element 6 abuts the pin 8 and prevents lifting of the pawl 3. If the lever 5 is moved into the locked position while the door is open, the spring 12 will be tensioned but the pin 11 which bears against the surface 10 will prevent the lever 6 from moving into the blocking position until the door is closed and the fork 2 is moved into the holding position.

When the door is unlocked by movement of the lever 5 into the FIG. 2 unlocked position, the lever 6 is moved into the unblocking position permitting free pivoting of the pawl 3. In this position the pin 8 can move in the slot 24 to release the fork 2.

Figure 3:
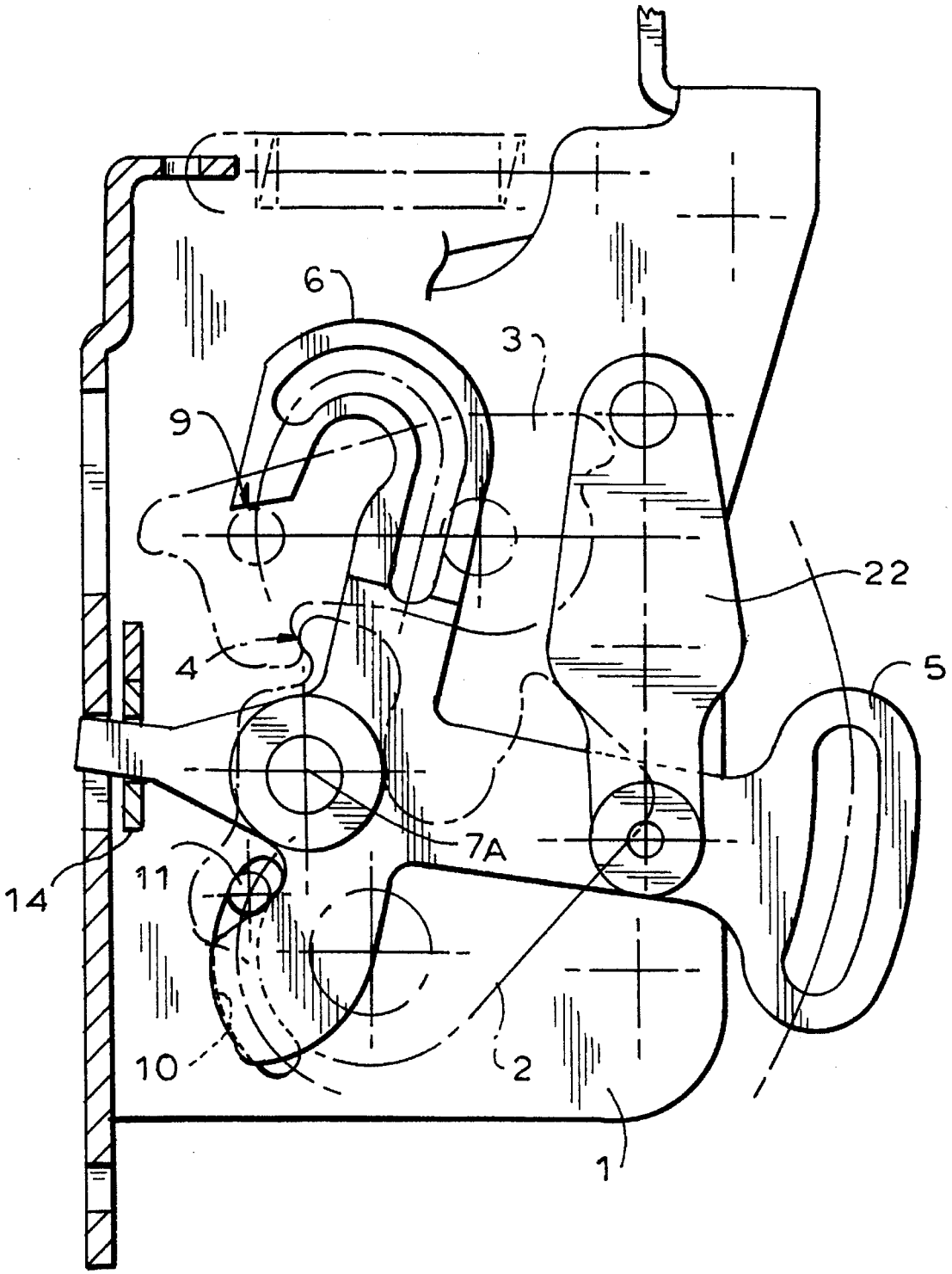
FIG. 3 is a view like FIG. 1 of a variation on the latch according to the invention.

The arrangement of FIG. 3 is for a system where no central lock system is provided. It is set up to prevent the door from being locked except when it is closed. Thus here the levers 5 and 6 are unitarily formed with each other. In this manner when the fork 2 is in the releasing position, the pin 11 will forcibly hold the levers 5 and 6 in the unlocked and unblocking positions and will only let them move back into the locked and blocking positions when the fork 2 moves into the holding position.

We claim:

1. A motor-vehicle door latch comprising:

a housing;

a latch fork pivotal on the housing between a holding position in which it is adapted to retain a door of the vehicle closed and a releasing position in which it allows the vehicle door to be opened;

a latch pawl pivotal on the housing between a retaining position engaging the fork and retaining it in the holding position and a freeing position out of engagement with the fork and permitting it to move into the releasing position;

means including a door handle and mechanism in the housing connected to the pawl for moving the pawl into the freeing position on actuation of the handle;

a locking lever connected to the mechanism and displaceable between a locked position in which it disconnects the mechanism from the pawl and prevents the mechanism from moving the pawl into the freeing position and an unlocked position in which it permits the mechanism to move the pawl into the freeing position;

a power actuator connected to the locking lever to move it between its positions;

a blocking element having a part engageable directly with the pawl and pivotal in the housing between a blocking position preventing movement of the pawl into the freeing position and an unblocking position permitting the pawl to move between its positions;

an actuator element on the fork preventing movement of the blocking element into the blocking position except in the holding position of the fork; and link means including a spring between the blocking element and the locking lever for urging the blocking element into the blocking position on displacement of the locking lever into the locked position.

2. The motor-vehicle door latch defined in claim 1 wherein the pawl and blocking element are pivotal about parallel axes and, in the blocking position of the element and retaining position of the pawl, the pawl bears radially of the blocking element axis on the blocking element.

3. The motor-vehicle door latch defined in claim 1 wherein the actuator element is formed directly on the fork and the blocking lever has a surface directly engageable with the actuator element.

4. The motor-vehicle door latch defined in claim 3 wherein the actuator element is a pin projecting from the fork and the surface is an edge of the blocking element.

5. A motor-vehicle door latch comprising:

a housing;

a latch fork pivotal on the housing between a holding position in which it is adapted to retain a door of the vehicle closed and a releasing position in which it allows the vehicle door to be opened;

a latch pawl pivotal on the housing between a retaining position engaging the fork and retaining it in the holding position and a freeing position out of engagement with the fork and permitting it to move into the releasing position;

means including a door handle and mechanism in the housing connected to the pawl for moving the pawl into the freeing position on actuation of the handle;

a locking lever connected to the mechanism and displaceable between a locked position in which it disconnects the mechanism from the pawl and prevents the mechanism from moving the pawl into the freeing position and an unlocked position in which it permits the mechanism to move the pawl into the freeing position;

a blocking element having a part engageable directly with the pawl and pivotal in the housing between a blocking position preventing movement of the pawl into the freeing position and an unblocking position permitting the pawl to move between its positions;

an actuator element on the fork preventing movement of the blocking element into the blocking position except in the holding position of the fork; and link means between the blocking element and the locking lever for displacing the blocking element into the blocking position on displacement of the locking lever into the locked position.

6. The motor-vehicle door latch defined in claim 5 wherein the link means is a solid connection between the blocking element and locking lever, the blocking element and locking lever being integral with each other.

* * * * *